US005782121A

United States Patent [19]

Wetzels

[11] Patent Number: 5,782,121

[45] Date of Patent: *Jul. 21, 1998

[54] APPARATUS FOR THE INNER PROFILING OF TUBES OR PIPES

[75] Inventor: Walter Wetzels, Aachen, Germany

[73] Assignee: Schumag AG, Aachen, Germany

[ * ] Notice: The term of this patent shall not extend beyond the expiration date of Pat. No. 5,524,467.

[21] Appl. No.: 659,236

[22] Filed: Jun. 5, 1996

Related U.S. Application Data

[63] Continuation-in-part of Ser. No. 276,052, Jul. 14, 1994, Pat. No. 5,524,467.

[30] Foreign Application Priority Data

Jul. 16, 1993 [DE] Germany ..... 43 23 840.8

[51] Int. Cl.[6] ..... B21B 15/00

[52] U.S. Cl. ..... 72/68

[58] Field of Search ..... 72/68, 77, 78, 72/96

[56] References Cited

U.S. PATENT DOCUMENTS 4,373,366 2/1983 Tatsumi .

4,864,836 9/1989 Ochiai .

FOREIGN PATENT DOCUMENTS 57-112911 7/1982 Japan .

163027 9/1984 Japan ..... 72/68

3-169421 7/1991 Japan .

*Primary Examiner*—Lowell A. Larson

*Attorney, Agent, or Firm*—W. G. Fasse; W. F. Fasse

[57] ABSTRACT

A pipe profiling machine improves the utilization of the working length of a profiling stone in the inner profiling of heat exchanger pipes. The press-on width of the revolving roller bodies, such as spherical, cylindrical, or barrel-shaped roller bodies, is substantially narrower than the profile width of the profiling stone so that in this area the profiling stone is worn out rapidly while the other area remains unworn. The press-on roller bodies and/or the profiling stone are/is oscillated axially back and forth within the axial working length of the profiling stone so that the entire profile range of the profiling stone can be utilized and so that radially outwardly projecting stripes on the pipes are avoided even if spherical roller bodies are used.

10 Claims, 5 Drawing Sheets

APPARATUS FOR THE INNER PROFILING OF TUBES OR PIPES

CROSS-REFERENCE TO RELATED APPLICATION

The present application is a Continuation-In-Part application of U.S. Ser. No. 08/276,052 filed jul. 14, 1994 now U.S. Pat. No. 5,524,467.

FIELD OF THE INVENTION

The invention relates to an apparatus for the inner profiling of pipes or tubes with a profiling stone arranged coaxially inside the pipe or tube.

BACKGROUND INFORMATION

A profiling stone for the above purpose has a cylindrical jacket surface facing, in the working position, the inner pipe surface, whereby the surface enclosed by the jacket surface comprises an outer surface profiling suitable for the production of the inner pipe profiling. A plurality of spherical bodies or balls are arranged around the circumference of the pipe. The balls press the pipe within a working range against the surface profiling of the profiling stone. For this purpose the balls perform a revolving motion around the pipe while the pipe is being moved axially at the same time, whereby undesirable outside stripes are formed on the pipe.

An apparatus for the above purpose is disclosed in U.S. Pat. No. 4,373,366 (Tatsumi) issued on Feb. 15, 1983, which makes efforts to "absorb" the stripes back into the pipe metal by a die through which the pipe passes. The formation of such radially outwardly protruding stripes is undesirable because the balls apply a high linear pressure along a spiral which forms these stripes. The pipe metal is worked non-uniformly and even if the stripes are "absorbed" back into the metal the outside pipe surface can be marred.

Conventional apparatus for the above purpose is equipped with a draw nozzle and a drawing device for transporting the pipe in a drawing direction, whereby a drawing mandrel is provided for cooperation with the draw nozzle. The drawing mandrel is arranged coaxially and comprises a supporting mandrel. A profiling stone is arranged at the free end of the supporting mandrel. The apparatus further includes a roller head with the above mentioned revolving balls, each of which is mounted for rotation about an axis coaxial with the pipe to be worked.

Japanese Patent Application No. 64-312046 published under No. 3-169421 (A) (Kawaguchi) discloses a method and the respective apparatus for performing the method wherein substantially cylindrical profiling stones inside the pipe to be profiled perform their function satisfactorily. However, the production of such stones is quite expensive. The outer revolving rollers have a rounded outer surface that make the pipe outer diameter smaller, because the pipe has initially an internal diameter somewhat larger than the outer diameter of the profiling stone. For this purpose the rounded rollers press the pipe against the profile of the profiling stone. This pressing takes place in a zone that is relatively short in the axial direction. This short zone is substantially shorter than the length of the profiling stone. As a result, the press-on forces can be maintained relatively small, whereby simultaneously the specific forces can be sufficiently large. However, this feature has the consequence that in the relatively small working range of the roller bodies the useful profile of the profiling stone is rather quickly worn out while the entire length of the profiling stone that could be used, is not in fact used. Hence, the expensive profiling stone must soon be exchanged, although only a portion of its entire profile is worn out while the rest of the profile is still as good as new.

OBJECTS OF THE INVENTION

In view of the foregoing it is the aim of the invention to achieve the following object singly or in combination:

- to provide an apparatus of the type described above with which it is possible to better utilize the profiling stone substantially along its entire length;
- to treat the pipe material more gently by applying more uniform surface pressures rather than line pressures along a helical line to avoid external stripes; and
- to prevent the external rollers or balls from forming radially outwardly extending stripes.

SUMMARY OF THE INVENTION

These objects have been achieved by an apparatus of the invention equipped with an oscillating drive which moves the profiling stone and/or the roller bodies periodically and axially relative to each other back and forth during the rotating motion of the roller bodies and during the axial motion of the pipe, whereby the working range of the rollers does not leave the axial range of the surface profile of the profiling stone. The "rollers" of the invention are either cylindrical, spherical, or barrel-shaped. The superimposed oscillating motion displaces the working range along the profiling stone. The working range (7) is desirably small. The back and forth oscillation along the profiling stone makes sure that substantially the entire profile of the stone is utilized. Simultaneously, it is possible to retain a relatively small press-on force especially with cylindrical or barrel-shaped rollers, while applying respective large specific forces. The relative axial oscillating motion may be accomplished by a respective relative motion among all coordinated structural components as well as by a respective axial motion of only the rollers or only the profiling stone while the respective other component remains stationary relative to the outer surroundings.

According to a further embodiment of the present apparatus the oscillating drive is so controlled that the relative velocity between the profiling stone and the roller bodies in the direction opposite to the axial motion direction of the pipe, is equal to, slower than, or faster than in the axial pipe motion in the opposite direction. Thus, it is possible to achieve an adaptation to the qualities of the pipe material being worked and to optimize the working speed while still avoiding external stripes.

A further embodiment of the invention provides that the axial relative motion between the profiling stone and the roller bodies is produced by a respective axial motion of the roller bodies while the profiling stone retains its position relative to the surroundings. An alternative to this version provides that the axial relative motion between the profiling stone and the roller bodies is produced by a respective axial movement of the profiling stone while the roller bodies retain their position relative to the surroundings. Both possibilities and a combination of these two possibilities make it possible to completely utilize the profile of the profiling stone along its working length.

In the present apparatus a roller head with the roller bodies or the roller head and/or the drawing head with the draw nozzle or the draw nozzle are power operated with the desired axial oscillating stroke to provide the required relative movement in the axial direction. These components are constructed for an axial back and forth movement with the desired velocity, whereby the profiling stone is arranged rotatably and fixed against axial movement in both directions on the support mandrel. Thus, known structural components of such pipe profiling machines may be retained and it is merely required that, for example, the roller head or the drawing head is made axially movable with a suitable slide provided with a suitable oscillating power drive. Such power drive can be a hydraulic cylinder or a simple spindle drive whereby the axial length of the oscillating motion and the motion velocity can be monitored respectively by known structural components such as displacement sensors or selsyn devices.

In order to achieve the desired relative motion in the axial direction it is not absolutely necessary that the entire roller head or the entire drawing head with the respective coordinated roller bodies or with the respective coordinated draw nozzle are moved. Rather, it is sufficient that the roller body alone or the draw nozzle alone is moved. This is possible when the mentioned structural components are mounted for axial displacement. For this purpose the draw nozzle can, for example, be constructed to include a ring piston for activating the draw nozzle.

A modified embodiment of the present apparatus has a roller body supported hydrostatically, whereby the diameters of the roller bodies can be kept small while using a rigid support and nevertheless a smoothly working bearing is achieved without the provision of special bearing elements such as roller bearings. Since the roller bodies and the entire roller head rotate very rapidly, for example at 15,000 r.p.m., a bearing support by means of roller bearings would be problematic.

Preferably, the roller bodies are constructed for adjustment in their radial position within an axial working range. This feature permits a precise adaptation to the desired roller dimensions.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 5:
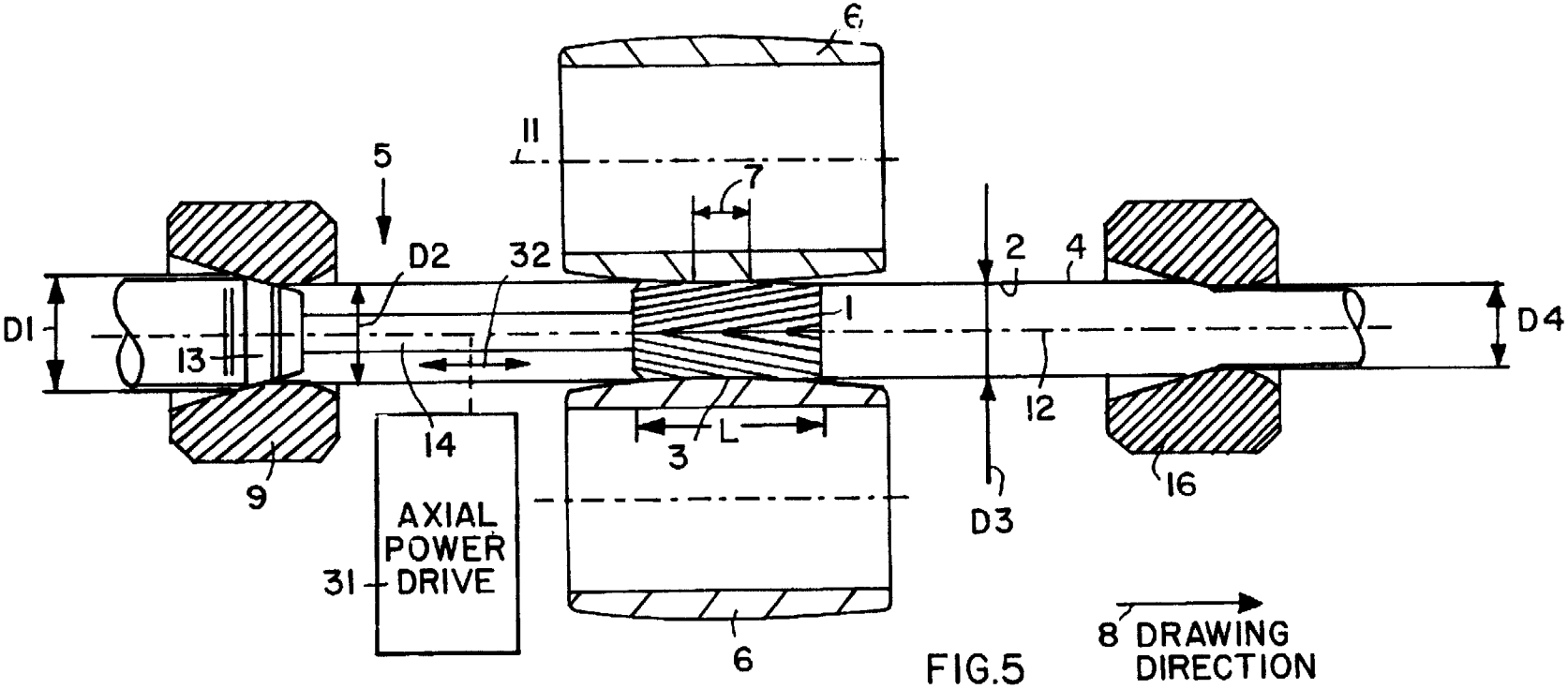
FIG. 5 shows an arrangement as in FIG. 4, however with barrel-shaped roller bodies and an oscillating power drive for the profiling stone.

Referring first to FIG. 5, a basic arrangement of a profiling stone 1 is positioned inside a pipe 5 to be profiled. According to FIG. 5 the pipe 5 shall be provided with an inner profile which is, for example, desirable for copper pipes of heat exchanger devices. For this purpose the stone 1 inside the pipe 5 is positioned inside of roller bodies, for example three barrel-shaped roller bodies 6. The pipe 5 has an outer diameter D1 which is reduced to a smaller outer diameter D2 in a draw nozzle 9 which is part of a known drawing apparatus not shown in FIG. 5. The wall thickness of the pipe 5 may simultaneously be reduced with the reduction of the other pipe diameter from D1 to D2. A drawing mandrel 13 arranged at the draw nozzle 9 is used for reducing the pipe diameter. Such diameter reduction is known and thus needs no further explanation.

Figure 4:
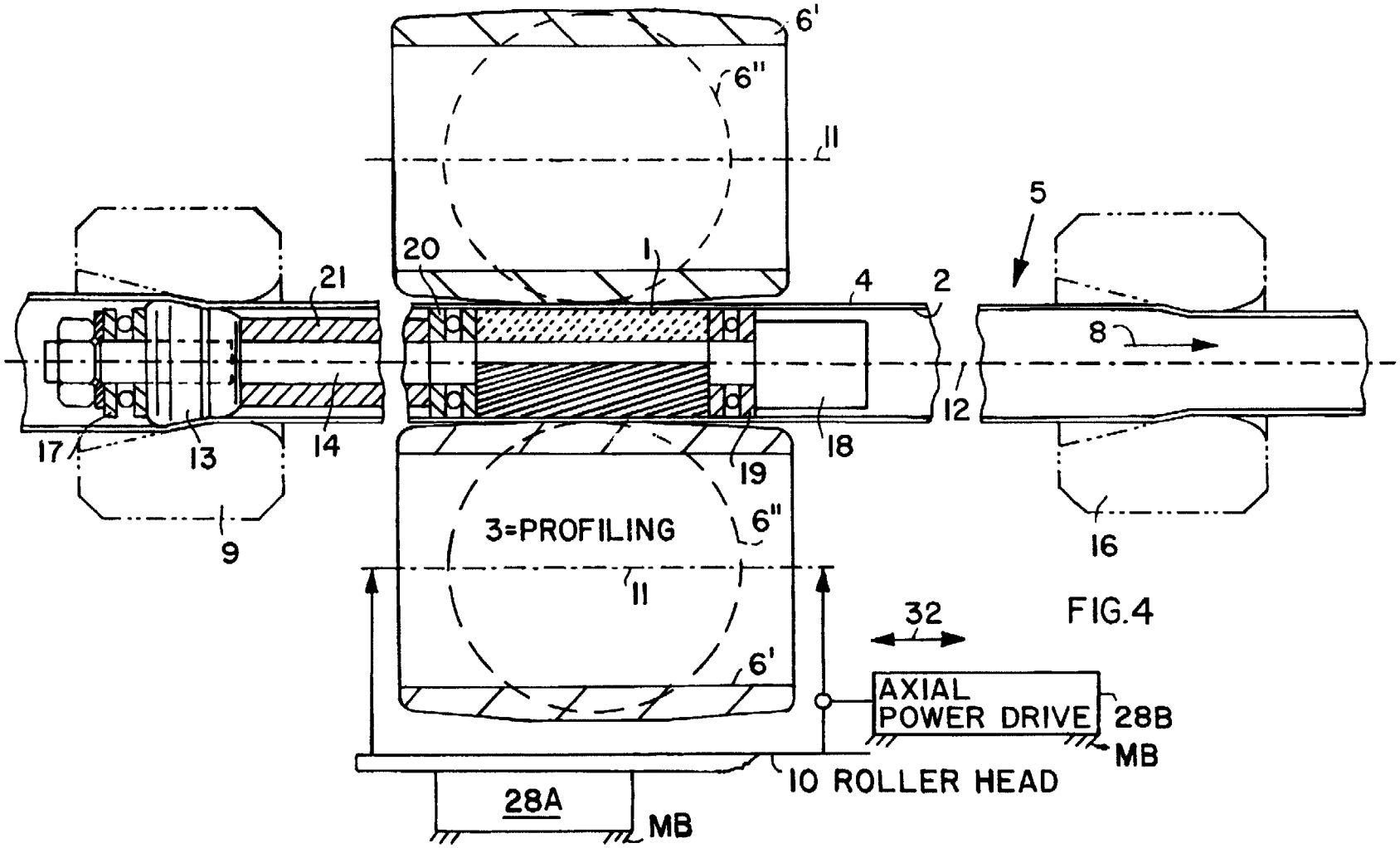
FIG. 4 shows a schematic arrangement of the profiling stone inside of spherical or substantially cylindrical roller bodies and also schematically showing an oscillating power drive for the rollers.

As shown in FIG. 4, the drawing mandrel 13 is rotatably mounted by a bearing 17 on to a support rod 14 arranged coaxially to the drawing mandrel 13 and also coaxially to the pipe 5. A profiling stone 1 is rotatably mounted to the free end of the support rod 14 by bearings 19 and 20. The barrel-shaped roller bodies 6 are arranged alongside the profiling stone 1 on the circumference 4 of the pipe 5. The roller bodies 6 are rotatably mounted in a roller head 10 shown in FIG. 1 for rotation about an axis 12 common to the stone 1, the pipe 4 and the components 9, 13, and 14. Each roller body is also mounted for rotation about its own axis 11. The roller bodies 6 have a working range 7 within which the roller bodies rest against the outer circumference 4 of the pipe 5 and thus against the barrel-shaped outer surface of the roller bodies 6. The roller bodies 6 compress the pipe wall within this working range 7 against the profile 3 of the profiling stone 1 so that a respective profile is impressed on the inner pipe wall 2, said inner pipe profile corresponding to the outer profile on the profiling stone 1. Thus, the pipe diameter D2 is reduced to the pipe diameter D3 between the roller bodies 6. After this profiling operation the pipe 5 is drawn through a calibration nozzle 16 to thereby reduce the pipe diameter to the diameter D4. During such working of the pipe 5 it performs an axial motion 8 due to a drawing force applied by a pulling drive not shown, while the roller bodies 6 simultaneously revolve rapidly around the pipe 5 driven by a respective rotary drive of a spindle head 22 shown in FIGS. 1 and 2.

FIG. 5 further shows an axial power drive 31 for axially oscillating the profiling stone 1 back and forth as indicated by the double arrow 32 and the respective dashed line symbolizing the drive effect of the power drive 31 on the elements 1, 13, and 14. Since the drawing mandrel 13 is connected to the profiling stone 1 through the rod 14, these three components are oscillated axially by the power drive 31 for example a solenoid surrounding the pipe 5 and effective through the pipe 5. The solenoid is energized for example by repeatedly reversing the polarity of its electrical energizing power or by two solenoids surrounding the pipe 5 and energized alternately to move the stone 1 axially in one axial direction by one solenoid and then in the opposite axial direction by the other solenoid of a pair. For this purpose the rod 14 or the core of the profiling stone 1, or the drawing mandrel 13 are constructed as the armature of the solenoid or solenoids of the power drive 31. The axial stroke of the power drive needs to be maximally as long as the axial length L of the stone 1.

FIG. 4 shows the same basic construction as FIG. 5. However, in FIG. 4 the arrangement and support of the profiling stone 1 is shown in more detail. The support rod 14 is rotatably mounted inside the drawing mandrel 13 and axially supported by the above mentioned bearing 17 which is an axial bearing. The free end of the support rod 14 has a shoulder forming a stop 18 against which an axial bearing 19 is supported. The profiling stone 1 is rotatably mounted on the support rod 14 and bears against this axial bearing 19. The support rod 14 also carries a second axial bearing 20 which bears on one side against the profiling stone 1 and with its opposite side against a spacer bushing 21 which may be constructed as an armature of one or two solenoids as described above. The spacer bushing 21 bears with its second facing side against the drawing mandrel 13 so that the profiling stone 1 is held with a determined and desired spacing from the drawing rod 13 and rotatable on the support mandrel 14. The elements 1, 13, 14, and 21 may be axially fixed, if the axial oscillating drive according to the invention is applied to the roller bodies 6' or 6" instead of to the elements 1, 13, 14, and 21.

FIG. 4 further shows a slide 28A in a machine bed MB on which the roller head 10 is slidable back and forth in the axial direction of the axis 12 of the pipe 5 driven by an axial power drive 28B for oscillating the roller head 10 and with it the barrel-shaped roller bodies 6' or the spheres 6" axially back and forth as shown by the double arrow 32.

Figure 1:
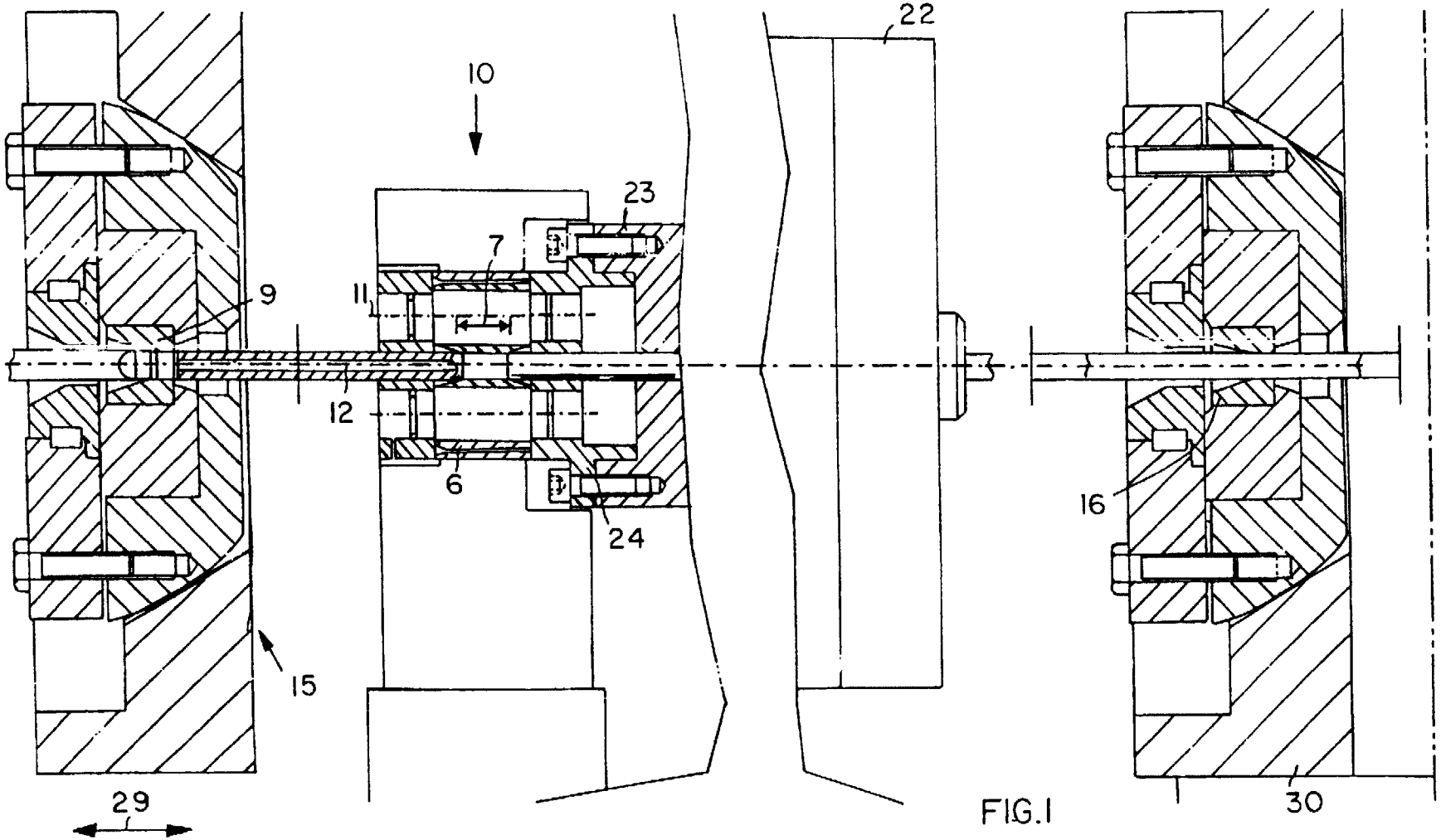
FIG. 1 shows a sectional view of a roller head with a draw nozzle arranged in front of the roller head and with a calibration draw nozzle arranged back of the roller head.
Figure 2:
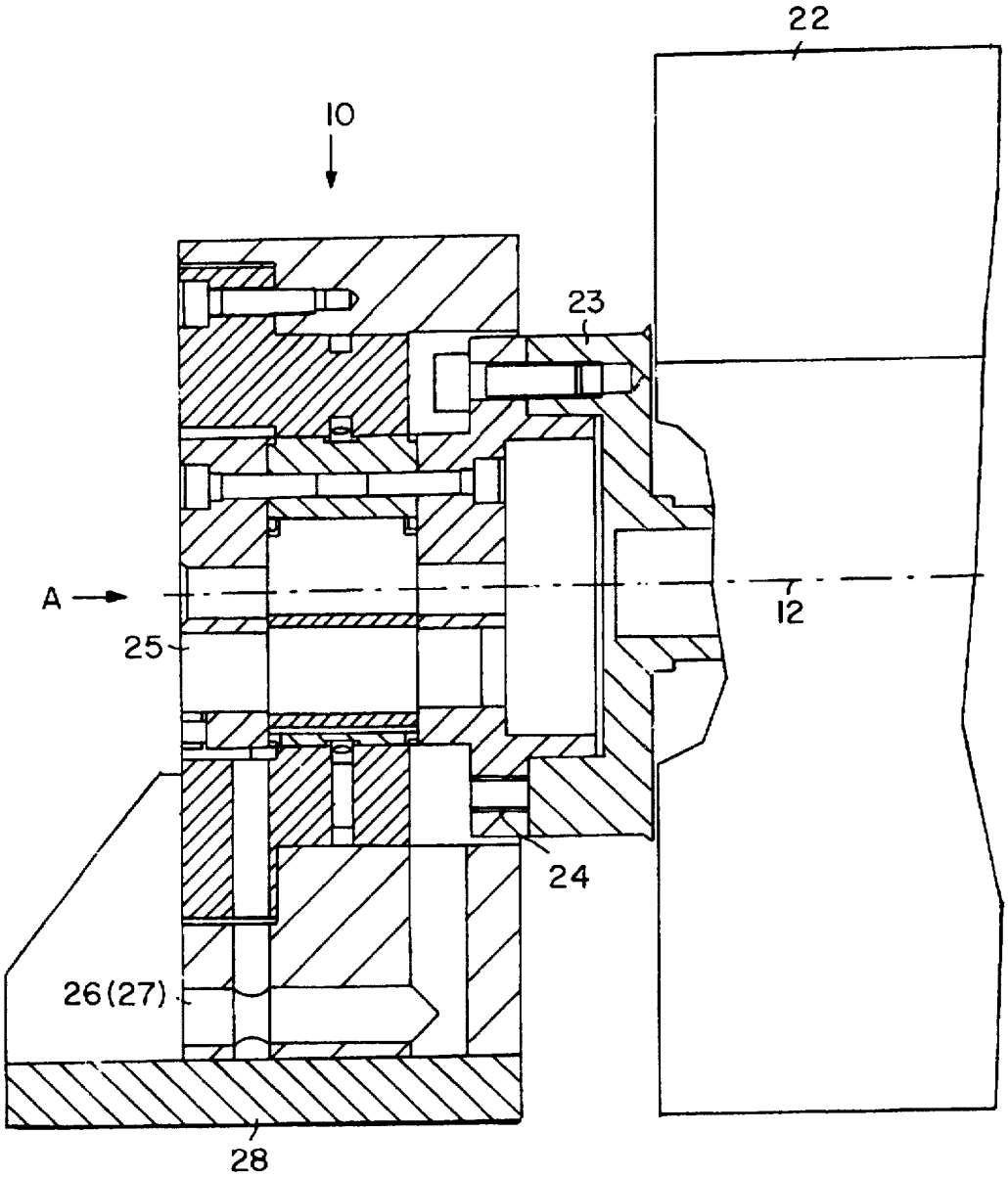
FIG. 2 shows a section through the roller head on an enlarged scale compared to FIG. 1.
Figure 3:
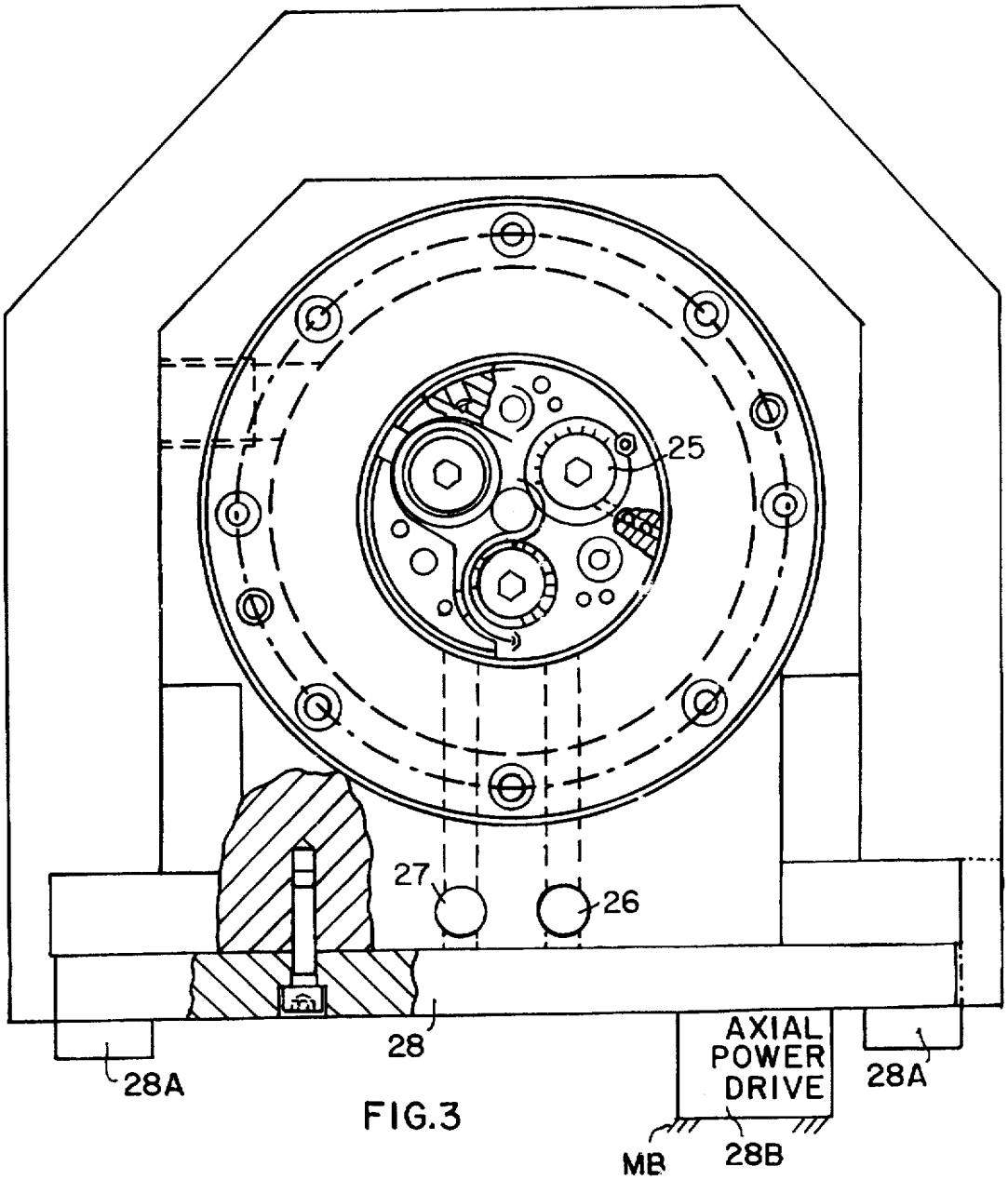
FIG. 3 is an axial view in the direction of the arrow A in FIG. 2.

FIG. 2 shows the roller head 10 in section while FIG. 3 shows a facing view according to arrow A in FIG. 2. The arrangement of the roller head in the entire system is shown in FIG. 1. A suitable construction for the hydrostatic bearing of the roller bodies 6 and their arrangement in a head that itself is rotatably mounted, may substantially be left to the person of ordinary skill in this art. Thus, only the critical structural components of an example embodiment according to FIGS. 1, 2 and 3 will be explained.

A spindle head 22 is arranged on the machine bed MB of conventional construction. The spindle head 22 supports a rotatably mounted drive spindle 23 which is connected with a rotational carrier 24 which is also rotatably mounted in the roller head 10 and which is assembled of several individual spindle head components of conventional construction. Bearing axles 25 of the roller bodies 6, or 6', or 6" are arranged in the rotational carrier 24 distributed around the circumference. In the example embodiment three bearing axles 25 are provided for respective roller bodies. The fluid required for the hydrostatic bearing support of the roller bodies 6 is supplied to the bearing axles 25 with the required pressure through the oil supply lines 26 and 27 shown in FIG. 3. Such hydrostatic bearings and the fluid supply and withdrawal required for these bearings are known in the art.

The free ends of the bearing axles 25 are arranged somewhat eccentrically relative to the bearing range of the roller bodies 6 to provide for a radial adjustment so that a rotation of the bearing axles 25 causes a radial positional displacement of the roller bodies 6. After the required rotational adjustment a clamping constructed in any desired way can then fix the bearing axles 25 in their adjusted position.

According to one embodiment of the invention the entire roller head 10 carrying the roller bodies 6, or 6', or 6" is mounted on the support 28 which in turn is slidably secured in a machine bed MB or which is, for example, mounted together with the spindle head 22 on a slide 28A that is movable back and forth by the axial power drive 28B for axially oscillating the roller bodies 6, or 6', or 6" along the stone 1. Mounting of the roller head 10 is possible either in a fixed position or as a movable mounting depending on whether the roller bodies or the profiling stone 1 is to be oscillated axially. With a respective radial adjustment of the roller bodies 6, or 6', or 6" these roller bodies press the pipe 5 as described against the outer profiling of the profiling stone 1 so that a respective counterprofiling on the inner pipe wall 2 is produced. For this purpose the roller bodies 6, or 6', or 6" are rotated by the spindle 23 of the spindle head 22. Both, the roller bodies and the rotatable roller body carrier 24 connected therewith revolve rapidly around the pipe 5 while the pipe is axially moved in an axial drawing direction 8 by a conventional drawing drive.

As far as the roller head 10 and spindle head 22 are arranged for axial movement on a slide or relative to a slide, these components are moved back and forth with the desired axial stroke and with the required speed as described above, whereby also the roller bodies 6, 6' or 6" and/or the stone 1 are moved correspondingly back and forth in the axial direction 32. As a result the roller bodies in their working range 7 can travel along the entire profile range of the profiling stone 1 which may be axially oscillatable or locally fixed as described so that the entire profile of the profiling stone is effectively and efficiently used.

Another possibility of utilizing the entire profile of the profiling stone resides in that the roller head 10, for example, is left stationary while the profiling stone 1 is axially moved back and forth inside the pipe 5 as described above or in that during the drawing operation the draw nozzle 9 is correspondingly moved axially back and forth, whereby the drawing mandrel 13 and thus, through the support rod 14, the profiling stone 1 is moved correspondingly back and forth. In order to achieve this, the draw nozzle 9 may alone be moved back and forth inside the draw head 15, for example in the form of a ring piston. Alternatively, as shown in the example embodiment in FIG. 1, the draw nozzle 9 can be moved back and forth by means of the entire drawing head 15. For this purpose the drawing head 15 can be constructed in a conventional manner. The draw head 15 is sufficiently shown in FIG. 1 with its construction that is known as such. However, in this last embodiment it is necessary to arrange the drawing head 15 on a respective slide in order to produce the required axial oscillating motion which is shown in FIG. 1 by the arrow 29.

A calibration head 30 having a calibration nozzle 16 is provided on the roller head 10 on its side opposite the drawing head 15 as viewed in the drawing direction. The calibration head 30 reduces the diameter of the pipe 5 after the profiling operation to the desired diameter D4, see FIG. 5. The construction of the calibration head 30 is known as such so that it does not need to be described in further detail.

In all embodiments the axial oscillating motion 32 is superimposed on the drawing motion whereby the respective velocity components are added during time intervals when the drawing motion and the oscillation motion are going in the same direction, and whereby these components partly cancel each other when the motions are going in opposite directions. All embodiments achieve a smooth outer pipe surface, a uniform working of the entire pipe material, and precise inner profiling without any formation of outer stripes with the added advantage of fully utilizing the profiling stone 1. Especially the roller bodies with a cylindrical surface or substantially cylindrical surface and the roller bodies with a barrel-shaped surface assure a uniform force distribution over a large surface area to thereby work the pipe material uniformly to prevent the formation of external stripes.

Although the invention has been described with reference to specific example embodiments, it will be appreciated that it is intended to cover all modifications and equivalents within the scope of the appended claims.

What is claimed is:

1. An apparatus for profiling an inner surface of a pipe (5), said apparatus comprising a profiling stone (1), a drawing mandrel (13) and a connecting rod (14) interconnecting said drawing mandrel (13) and said profiling stone (1) with each other for positioning coaxially inside said pipe, said profiling stone comprising a profiling surface (3) facing an inner pipe surface in a working position of said profiling stone (1), said apparatus further comprising a plurality of roller bodies (6, 6', 6") arranged on the outer circumference (4) of said pipe (5) for pressing said pipe (5) within a working range (7) of said roller bodies against said profiling surface (3) of said profiling stone (1), said roller bodies being adapted for performing a revolving motion around said pipe (5), a rotary drive for rotating said profiling stone (1) inside said pipe to be profiled about a longitudinal axis (12) extending in a feed advance direction of said pipe, a spindle head (22) for simultaneously revolving said roller bodies (6, 6', 6") about said longitudinal axis (12) while permitting each of said roller bodies to rotate about its individual roller body axis (11), an axial power drive for imparting to at least one of said profiling stone (1) and said roller bodies (6, 6', 6") a periodic axial oscillating motion back and forth in said feed advance direction for superimposing on said drawing motion a relative axial displacement in said axial feed advance direction between said profiling stone (1) and said roller bodies (6, 6', 6"), and means for limiting said relative axial displacement so that a working range (7) of said roller bodies (6) remains within said surface profile (3) of said profiling stone (1).

2. The apparatus of claim 1, wherein said axial power drive is connected to said roller bodies (6, 6', 6") for oscillating said roller bodies axially back and forth in said feed advance direction (32) of said pipe (5) while said profiling stone (1) is axially fixed.

3. The apparatus of claim 1, wherein said axial power drive is connected to said profiling stone (1) for oscillating said profiling stone (1) axially back and forth in said feed advance direction (32) of said pipe while said roller bodies (6) are axially fixed and revolving.

4. The apparatus of claim 1, wherein said axial power drive is connected to said profiling stone (1) and to said roller bodies for axially oscillating said roller bodies (6) and said profiling stone (1) axially back and forth in said feed advance direction of said pipe while said roller bodies are revolving.

5. The apparatus of claim 1, wherein said axial power drive is energized for selecting a relative velocity for said relative axial displacement in a direction opposite to said feed advance direction, so that said relative velocity in said opposite direction is equal to, or slower than, or faster than a respective velocity in said feed advance direction of said pipe.

6. The apparatus of claim 1, further comprising a hydrostatic bearing for supporting said roller bodies hydrostatically.

7. The apparatus of claim 1, further comprising means for radially adjusting said roller bodies (6, 6', 6") in a direction extending radially to said longitudinal axis (12) within said working range (7) of said roller bodies.

8. An apparatus for profiling an inner pipe surface of a pipe (5) axially movable through said apparatus, said apparatus comprising a profiling stone (1), a drawing mandrel (13) and a support rod (14) interconnecting said profiling stone (1) and said drawing mandrel (13) with each other for positioning coaxially inside said pipe, said profiling stone having a profiling surface (3) facing an inner pipe surface in a working position of said profiling stone (1) for the production of an inner profiling inside said pipe, a plurality of roller bodies (6, 6', 6") arranged on the outer circumference (4) of said pipe (5) for pressing said pipe (5) within a working range (7) of said roller bodies against said profiling surface (3) of said profiling stone (1), said roller bodies being adapted for performing a revolving motion around said pipe (5), said apparatus further comprising at least one first bearing (20) rotatable supporting said profiling stone (1) on said support rod (14) for rotation about a longitudinal axis (12) of said support rod (14), a spindle head (22) for simultaneously revolving said roller bodies (6, 6', 6") about said longitudinal axis (12) while permitting each of said roller bodies to rotate about its individual roller body axis (11), and an axial power drive for imparting to at least one of said profiling stone (1) and said roller bodies (6, 6', 6") a periodic axial oscillating motion back and forth in said feed advance direction for superimposing on said drawing motion a relative axial displacement in said axial feed advance direction between said profiling stone (1) and said roller bodies (6, 6', 6"), said apparatus further comprising a second bearing (17) positioned to permit relative rotation between said support rod (14) and said drawing mandrel (13), and a spacer bushing (21) surrounding said support rod (14), said spacer bushing abutting with one bushing end against said first bearing (20) and holding with the other bushing end said drawing mandrel (13) against said second bearing (17).

9. A rod and mandrel assembly for an apparatus for profiling an inner pipe surface comprising a first mandrel forming a profiling stone (1), a support rod (14), at least one first bearing (20) positioned on said support rod (14) to permit relative rotation between said profiling stone (1) and said support rod (14), a second mandrel forming a pipe drawing mandrel (13), at least one second bearing (17) positioned on said support rod to permit relative rotation between said drawing mandrel (13) and said support rod, and a spacer bushing (21) surrounding said support rod (14), said spacer bushing abutting with one bushing end against said first bearing (20) and holding with the other bushing end said drawing mandrel (13) against said second bearing (17).

10. The assembly of claim 10, comprising two first bearings (19, 20) forming two axial thrust bearings (19, 20) one of which is positioned on said support rod (14) at each end of said profiling stone (1), and wherein said second bearing (17) is also an axial thrust bearing.

* * * * *

UNITED STATES PATENT AND TRADEMARK OFFICE

CERTIFICATE OF CORRECTION

PATENT NO. : 5,782,121

DATED : Jul. 21, 1998

INVENTOR(S) : Wetzels

It is certified that error appears in the above-identified patent and that said Letters Patent is hereby corrected as shown below:

Col. 8, line 16, after "bearing (20)" replace "rotatable" by --rotatably--;

line 48, after "claim" replace "10," by --9,--.

Signed and Sealed this

Twenty-ninth Day of September, 1998

*Attest:*

*Attesting Officer*

BRUCE LEHMAN

*Commissioner of Patents and Trademarks*